United States Patent [19]

Lehmkuhl et al.

[11] 4,173,517

[45] Nov. 6, 1979

[54] ELECTROCHEMICAL PROCESS FOR DICYCLOPENTADIENYL IRON

[75] Inventors: Herbert Lehmkuhl; Wilhelm Eisenbach, both of Mülheim an der Ruhr, Fed. Rep. of Germany

[73] Assignee: Studiengesellschaft Kohle mbH, Mulheim an der Ruhr, Fed. Rep. of Germany

[21] Appl. No.: 901,918

[22] Filed: May 1, 1978

[30] Foreign Application Priority Data

May 5, 1977 [DE] Fed. Rep. of Germany ..... 2720165

[51] Int. Cl.[2] ..... C25D 3/12

[52] U.S. Cl. ..... 204/59 QM

[58] Field of Search ..... 204/59 QM

[56] References Cited

U.S. PATENT DOCUMENTS 2,960,450 11/1960 Giraitis et al. ..... 204/59 QM

OTHER PUBLICATIONS

Valcher, Chemical Abstracts, vol. 72, Abstract 17834j, 1970.

*Primary Examiner*—F. C. Edmundson

*Attorney, Agent, or Firm*—Sprung, Felfe, Horn, Lynch & Kramer

[57] ABSTRACT

Dicyclopentadienyl iron (ferrocene) is produced directly from iron and cyclopentadiene, or derivatives thereof, by electrolyzing a conductive salt-containing solution of a monomeric cyclopentadiene compound in an inert solvent, between an iron anode and a cathode which is inert to the electrolyte.

11 Claims, No Drawings

ELECTROCHEMICAL PROCESS FOR DICYCLOPENTADIENYL IRON

This invention relates to an electrochemical process for the direct synthesis of dicyclopentadienyl iron from metallic iron and cyclopentadiene.

Dicyclopentadienyl iron (ferrocene) is the best known representative of a large group of compounds which are derived from cyclopentadiene and characteristically have a sandwich structure. Ferrocene and its derivatives are technically interesting because they may be used as catalysts for the curing of polyester resins, as combustion catalyst for low fuel combustion (fuel oil additives), as anti-knock agents, as iron preparations for the pharmaceutical field and as monomers for refractory polymers.

Ferrocene and its derivatives have hitherto been prepared by the reaction of anhydrous iron halides with alkali metal, magnesium beryllium or mercury cyclopentadienide. Alkali metal, magnesium, beryllium and mercury halides are produced as side products of the reaction. Another method of preparation consists of reacting iron (II) halides with cyclopentadiene in the presence of a strong base (e.g., diethylamine or pyridine). In this reaction, hydrohalides of the base are formed as noxious by-products.

An electrochemical process for the production of dicyclopentadiene iron has been described in the literature. (S. Valcher and E. Alunni, La Ricerca Scientifica 38, 527 (1968)). In this process, cyclopentadienyl groups are transferred from thallium cyclopentadienide to iron by anodic oxidation on iron electrodes, and metallic thallium is deposited at the cathode. The overall reaction may therefore be represented as follows:

$$2TlCp + Fe \rightarrow Fe(Cp)_2 + Tl$$

(Cp=cyclopentadiene)

The yields are said to be from 91 to 95%. The disadvantages of this process lie in the necessity of handling poisonous thallium compounds and metallic thallium and of reconverting thallium into thallium cyclopentadienide for a continuous production process. This reconversion of thallium into the cyclopentadienide is carried out by dissolving thallium in nitric acid, precipitating it as thallium hydroxide by the addition of sodium hydroxide solution and converting it into thallium cyclopentadienide by reaction with cyclopentadiene. Sodium nitrate is formed as unwanted by-product.

The present invention provides an improved process for the direct synthesis of ferrocenes from iron and cyclopentadiene or derivatives of cyclopentadiene.

The process of the invention for the direct productions of ferrocenes from iron and cyclopentadiene or its derivatives, comprises electrolyzing a solution of a monomeric cyclopentadiene compound, i.e., cyclopentadiene or a corresponding cyclopentadiene derivative, in an inert solution, which solution contains conductive salts, on an iron anode and a cathode which is inert toward the electrolyte.

Suitable inert solvents include, in particular, aliphatic, aromatic and cycloaliphatic nitriles, especially acetonitrile, which is readily available and inexpensive, and/or N-dialkyl-carboxylic acid amides. Dimethylformamide or mixtures of dimethylformamide with, e.g., acetonitrile are particularly suitable.

Salts which dissociate into ions and are difficult to reduce may be used as conductive salts. Alkali metal salts and/or tetraorgano ammonium salts are particularly suitable, especially the tetraalkylammonium salts. Particularly suitable are the corresponding halides of which the iodides and, more particularly, the bromides and chlorides are of importance. Lithium halides and/or sodium halides may be exceptionally suitable conductive salts.

The cathodes used may be made of any conducting materials which are inert towards the electrolytes, e.g., metals such as Al, Hg, Pb, Sn, graphite, Fe, Pt, Ni, Ti, Co, and the like.

The process is suitably carried out at temperatures of from 0° to 150° C., in particular within the range of from 20° to 80° C. The electrodes are preferably placed as close together as possible. A distance of about 0.2 to 2 cm, for example, is suitable.

The organic starting material used may be either monomeric cyclopentadiene or monomeric derivaties thereof, for example, methyl cyclopentadiene or indene. Further examples are:

Methyl, ethyl, propyl, isopropyl, butyl, sec.-butyl, tert.-butyl and amylcyclopentadiene, methyl, ethyl, propyl and butyl esters of cyclopentadiene carboxylic acid, cyclopentadienyl amine, trimethyl-cyclopentadienylsilicon, cyclopentadienylcyanide, cyclopentadienylmethyl ketone, cyclopentadienyl methyl ether, fluorene and indene.

The following examples illustrate the invention:

Example 1

A solution consisting of 150 ml of dimethylformamide, 50 ml of freshly distilled cyclopentadiene and 3.4 g of lithium bromide was electrolyzed at a terminal voltage of 5.2 volts and current of 0.5 amps. in an electrolytic cell having an iron anode and a nickel cathode. The effective electrode surface are of the electrode was 40 $cm^2$ and the distance between the electrodes was 10 mm.

After 10 ampere hours, the electrolyte consisted of a dark brown solution containing orange colored crystals. The solvent was distilled off and the ferrocene was extracted from the solid residue with boiling pentane. The pentane extract was concentrated to about 10 to 15 ml by evaporation and cooled to 0° C. The ferrocene which crystallized from the extract was filtered off. The yield of pure ferrocene, based on the quantity of current, was 88%, and the weight loss of the anode was 91%.

The mass spectrum of the ferrocene was identical to that of an authentic sample and the melting point was 173° C.

LiCl or $N(C_4H_9)_4Br$ may be used as conductive salt instead of LiBr. Both the conductivity and the yields obtained are comparable.

Example 2

A solution consisting of 190 ml of acetonitrile, 45 ml (540 mMol) of freshly distilled cyclopentadiene and 3.8 g of LiBr was electrolyzed between an iron anode and a nickel cathode for 15 hours at 0.4 amps. and a terminal voltage of 8.5 volts. The weight loss of the iron anode was 90% based on the quantity of current, while Fe(O) was changed to Fe(II).

All volatile constituents were evaporated from the reaction product at 20° C./0.01 Torr and the dark brown residue was extracted with pentane. The extract was concentrated by evaporation to about 15 ml and cooled to 0° C. Ferrocene crystallized in the form of orange crystals which were filtered off, washed with a small quantity of pentane and dried. 15 g of pure ferrocene were obtained, corresponding to 78%, based on the quantity of current.

EXAMPLE 3

The procedure was the same as described in Example 2, but using cathodes of graphite, lead, tin, cobalt or iron. The yields of ferrocene were between 75% and 90%, based on the quantity of current used.

EXAMPLE 4

The procedure was the same as in Example 1, but using sodium bromide as conductive salt instead of lithium bromide. The yield of ferrocene was 88%.

EXAMPLE 5

A solution consisting of 150 ml of dimethylformamide, 38.5 g of indene and 3.8 g of sodium bromide were electrolyzed in the same electrolytic cell as in Example 1, using a terminal voltage of 4.8 volts and a current of 0.5 amps.

After 6 ampere hours, the electrolyte consisted of a very dark solution containing dark red crystals. All the solvent was evaporated off and the reaction product was extracted from the residue with pentane. The crystals which precipitated from the pentane extract after concentration by evaporation were filtered off.

The yield of crystalline reaction product was 8.5 g, which corresponds to 48%, based on the loss at the iron anode. The anode current yield was 54%.

The reaction product was finally sublimed at 100° C. and 0.001 Torr. Dark red crystals were obtained.

EXAMPLE 6

A solution consisting of 150 ml of dimethylsulphoxide, 50 ml of freshly distilled cyclopentadiene and 3.1 g of NaBr was electrolyzed in an electrolytic cell described in Example 1, using a terminal voltage of 5.6 volts and a current of 0.5 amps.

After about 10 ampere hours, the electrolyte consisted of a red brown solution with orange colored crystals. The whole electrolyte left at the end of electrolysis was extracted with pentane in a liquid-liquid extractor. Ferrocene was isolated from the pentane phase in a yield of 95%, based on the loss at the anode. The second phase consisted of dimethylsulphoxide, together with the added conductive salt. The DMSO could be recovered 99% pure by vacuum distillation.

EXAMPLE 7

A solution of dimethylformamide and NaBr containing 20% of freshly distilled cyclopentadiene was electrolyzed between iron anodes and nickel cathodes in a continuously operating industrial apparatus.

The electrolytic cell contained a packet of 10 iron plates, 2 mm in thickness and 10 cm in width, as anodes inside a 5 liter glass container. The cathode consisted of a packet of 11 nickel discs mounted on a common shaft at intervals of 9 mm. The effective electrode surface area was 8.65 $dm^2$.

During electrolysis, the electrolyte was kept in continuous circulation by pumping at the rate of about 10 liters/hour, first passing through a cooling vessel and a filter. After saturation of the electrolyte, ferrocene crystallized due to the different temperature in the cell and in the cooling vessel and could be removed from the filter from time to time.

The terminal voltage was 3.6 volts and the current density 27 amps.

After 2420 ampere hours, 2508.5 g of iron had dissolved at the anode, corresponding to a current yield of 99.0%. 9625 g of reaction product precipitated during this time. 6060 g of pure ferrocene, corresponding to 72.5%, based on the loss at the anode, were isolated from this precipitated reaction product by washing with dilute hydrochloric acid. At the end of the experiment, the electrolyte still contained 1070 g of ferrocene in solution. This could be isolated by removal of the solvent by evaporation and purification of the residue by extraction. The total yield of 7130 g of ferrocene corresponds to 85.3% of the theoretical yield.

It will be understood that the specification and examples are illustrative, but not limitative of the present invention and that other embodiments within the spirit and scope of the invention will suggest themselves to those skilled in the art.

What is claimed is:

1. A process for the direct production of ferrocenes from iron and cyclopentadiene or derivatives of cyclopentadiene, comprising electrolyzing a conductive salt-containing solution of a monomeric cyclopentadiene compound in an inert solvent, between an iron anode and a cathode which is inert toward the electrolyte.

2. Process as claimed in claim 1 in which the conductive salt in said solution comprises an alkali metal salt.

3. Process as claimed in claim 1 in which the conductive salt in said solution comprises a tetraorganic ammonium salt.

4. Process as claimed in claim 2 wherein the salt is a halide.

5. Process as claimed in claim 4 wherein the halide salt is at least one of lithium and sodium halide.

6. Process as claimed in claim 1 wherein the electrolysis is carried out at a temperature of from 0° to 150° C.

7. Process as claimed in claim 6 wherein the process is carried out at a temperature of from 20° to 80° C.

8. Process as claimed in claim 1 wherein the inert solvent is at least one of aliphatic, aromatic or cycloaliphatic nitriles and N-dialkyl carboxylic acid amides.

9. Process as claimed in claim 1 wherein the distance between the anode and cathode is from 0.2 to 2 cm.

10. Process as claimed in claim 1 wherein the cyclopentadiene compound is cyclopentadiene.

11. Process as claimed in claim 1 wherein the cyclopentadiene compound is a cyclopentadiene derivative.

* * * * *